United States Patent [19]

Schwing

[11] 4,373,875

[45] Feb. 15, 1983

[54] VISCOUS MATERIAL PUMP, IN PARTICULAR FOR THE CONVEYANCE OF CONCRETE

[75] Inventor: Friedrich Schwing, Herne, Fed. Rep. of Germany

[73] Assignee: Friedrich Wilh. Schwing GmbH, Herne, Fed. Rep. of Germany

[21] Appl. No.: 176,283

[22] Filed: Aug. 8, 1980

[30] Foreign Application Priority Data

Aug. 16, 1979 [DE] Fed. Rep. of Germany ..... 2933128

[51] Int. Cl.[3] ..... F04B 15/02

[52] U.S. Cl. ..... 417/517; 417/519; 417/532; 417/900

[58] Field of Search ..... 417/516, 517, 518, 519, 417/532, 900

[56] References Cited

U.S. PATENT DOCUMENTS

| | | | |
|---|---|---|---|
| 3,298,322 | 1/1967 | Sherrod . | |
| 3,963,385 | 6/1976 | Caban | 417/517 |
| 3,982,857 | 9/1976 | Schlecht | 417/519 |
| 4,178,142 | 12/1979 | Schwing | 417/516 |
| 4,191,513 | 3/1980 | Schwing | 417/517 |

FOREIGN PATENT DOCUMENTS

| | | | |
|---|---|---|---|
| WO80/01594 | 8/1980 | PCT Int'l Appl. | 417/516 |

*Primary Examiner*—Richard E. Gluck

*Attorney, Agent, or Firm*—Andrus, Sceales, Starke & Sawall

[57] ABSTRACT

A viscous material pump, in particular for the conveyance of concrete through a housing (3) of a switch tube (2) has a swivel body (26) fastened on an axially supported pivot shaft (44). The swivel body alternately connects a discharge opening (25) mounted in a housing wall with two inlet openings (6, 7) arranged in another housing wall. The centers of the inlet and outlet openings, respectively, are arranged in radial displacement from the shaft axis (35). The displacement of the inlet openings (6, 7) and the discharge opening (25) from the shaft axis (35) differs and is so selected that the displacement ($R_1$) of the inlet openings (6, 7) is larger than the displacement ($R_2$) of the discharge opening (25).

5 Claims, 5 Drawing Figures

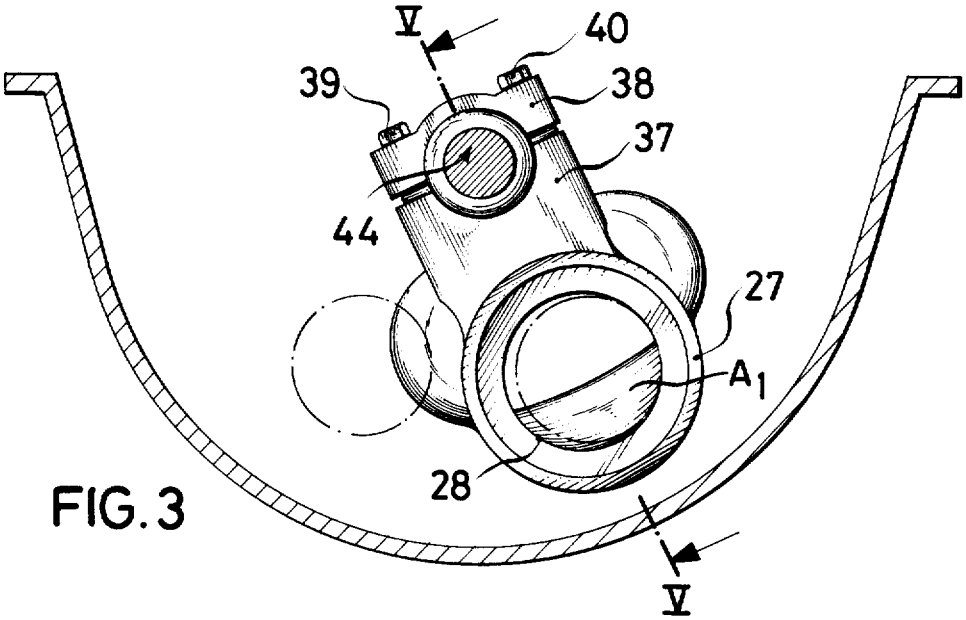
FIG. 3
FIG. 4
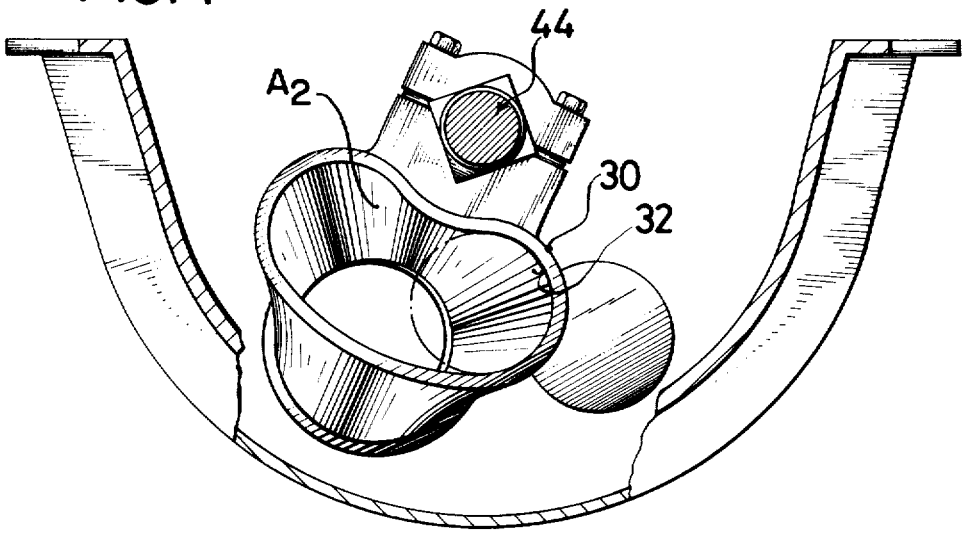

VISCOUS MATERIAL PUMP, IN PARTICULAR FOR THE CONVEYANCE OF CONCRETE

The invention relates to a viscous material pump, particularly for the conveyance of concrete through a housing of a switch tube that has a swivel body fastened on a pivot shaft. The swivel body alternately connects a discharge opening mounted in a housing wall with two inlet openings arranged in another housing wall, whereby the center of the input and output openings, respectively, are arranged in radial displacement from the shaft axis.

The viscous material pump according to the invention can transport material mixtures of mud-like consistency, for example, settling mud, in addition to concrete. The invention will, however, be described in the following in connection with the transport of concrete because that medium is a particularly difficult pumpable supply medium on a variety of grounds, for example, on account of the impairment introduced through the hydraulic losses of the concrete and the wear effect of the sand contained in the concrete. The viscous material pump according to the invention has, as a rule, two alternately supplying cylinders, the inlet openings of which are arranged in the housing of the switch tube and through which the incremental material portion pressed out of the cylinder by the associated piston arrives in the swivel body. The discharge opening is by comparison preferably arranged as a conveying conductor, into which the pumped concrete is guided. The switch tube renders it feasible for the respective suctioning transport cylinder to suck the concrete out of a reservoir, typically fastened over the housing, said concrete being conveyed in the subsequent pump cycle.

Concrete pumps of this type are described in the introduction and are known in many other exemplary forms. Their previously described principle is, in the practice, not easy to control, in particular when faced with high transport resistance. In this connection, there occurs considerable hydrostatic force, for example, on the order of magnitude of 20,000 kp, which thus leads to deformation arising even with ample dimensioning of the thereby elastically loaded elements, that must furnish the opposing force. These deformations lead to the formation of fractures in the repetitively sliding solid bodies of the tube switch. In this manner leakage emerges even without the deteriorating influence of the unavoidable wear that leads to the pressing of the fluid portion out of the concrete and therewith to operating breakdowns. Beyond that, fractions of the sand forcibly enter in the cracks so occurring which are trapped with the unloading arising after each swivel operation of the tube switch. This leads to switching malfunctions and to excessive wear.

The seals proposed for the disposition of such problems provide for example, an axially displaceable wear ring arranged in the swivel body, which is loaded with the pressure of the conveyed medium and becomes compressed (DE-OS No. 2,614,895). It has, however, turned out that also in this connection the sand leads to jamming. Also, the gap between the end of the swivel body and the wear ring arranged on it changes its length with the loading and with the resulting elongation of the countering apparatus is, during the pressure stroke, on the order of magnitude of many millimeters larger. During the switching process of the tube switch occurs an unloading, that also releases the elastically stressed countering apparatus, so that the referred to ring gap is again compressed. One thus endeavors, through short tie rods or deflection supports, to hold the elastic deformation as small as possible.

It is known (DE-PS No. 1,285,319) to form the swivel body as a pipe, that is approximately S-formed bent, so that the discharge opening of the swivel pipe has the same free surface as the discharge opening of the housing. In this situation, the hydrostatic forces, which would otherwise act in the shaft axis, thus compensate. In the inlet openings, that are arranged in displacement from the axis of the swivel shaft, appear however bending moments, that are determined by the size of the forces and their radial distance from the shaft axis. That leads to the kanting of the reservoir, because the pivot shaft is journalled in its wall and thus to the referred to crack formation in the inlet opening.

With another of the previously known viscous material pumps (DE-AS No. 2,104,191), which likewise utilizes a generally S-formed bent pipe as a swivel body, the referred to moments are absorbed in the bearing of the shaft. This causes a much larger shaft diameter, in order to avoid the elastic deformations and associated crack formation. With the previously mentioned high conveying resistances, such embodiments therefore are not practically realizable.

Another of the known viscous material pumps (DE-PS No. 2,162,406) provides as a swivel body a generally U-formed bent pipe, whose back is supported on a cross bar in the region of the lower swivel. In contrast to the aforementioned exemplary embodiments this support of the swivel pipe slides in the medium being conveyed, which further increases the friction and the wear. Also the cross bar must be fastened with proportionately long tie bars. The elastic deformations appearing on the basis of the considerable elastic extension of the tie bars and the deflection of the cross bar leads to increased size magnitude of the cracks that form in the inlet openings.

The invention proceeds from a previously known viscous material pump (DE-AS No. 1,278,247 corresponding U.S. Pat. No. 3,298,322). The tube switch is provided with a swivel body that accommodates the curvature of the housing bottom which has a round inlet opening and two discharge openings whose boundary edges partially coincide. Thus the displacement of all three openings from the axis of the swivel shaft is similar in magnitude. For the sealing of the inlet openings, a spectacle-like plate is set on the inner wall of the housing involved. A considerable axial force acts on this element. It is desired to remove this axial force on the housing by means of the swivel shaft, resulting in considerable forces perpendicular to the shaft that elastically deform the shaft, whose sufficient strength is presumed, and thus would lead to the tilting of the housing and of the swivel body in the housing. Thus occurs also with this embodiment jamming on the basis of the crack formation emerging with the operation of the swivel body, the considerable wear derived therefrom, and the thus attributable unsatisfactory operating reliability.

The invention has as its object to so form the previously proposed viscous material pumps that the mechanical loading of the housing wall forming the inlet openings is strongly diminished, without requiring that the increased bending loading of the swivel shaft be taken as a trade off.

According to the invention, this object is thus achieved with the initially pointed out viscous material pump, in that the swivel shaft is axially supported and the displacements of the input openings and the output opening from the shaft axis differ and are so chosen that the displacement of the inlet openings is greater than the displacement of the discharge opening.

According to the invention, through the selection of the displacements a point lying on the shaft axis correspondingly attains a moment free condition or approximately moment free condition. The remaining axial force can, in this way, be removed deflection free from the shaft generally through a bearing loaded in compression or tension. This bearing can be arranged outside the mass to be conveyed. Moreover, the sealing is simplified through the unloading of the housing wall, whereupon the possibility exists to arrange axially movable gaskets on the openings of the swivel body.

One achieves a fully moment free condition, according to the invention, when in the swivel body, the product of the discharge surface or surfaces and the displacement of the common center of gravity from the shaft axis is similar to the product of the inlet surface and the displacement of its center of gravity from the shaft axis.

It is naturally also expedient to design the swivel angle of the swivel body as small as possible. Within the contemplation of the viscous material pump according to the invention it is thus provided in the swivel body that the outline of the partially coincident discharge openings is formed kidney shaped.

According to a further feature of the invention, a thrust bearing arranged in the discharge side of the housing is provided for the axial support of the swivel shaft. This thrust bearing is loaded with the swivel shaft in the direction opposing the conveying direction.

According to a further feature of the invention, the swivel shaft has an axial thrust bearing on the input side of the housing that is formed as a stressing device for the housing.

With shortened construction of the swivel body, arises shortened components of the housing that can be strongly designed without increased cost so that only minimal elongation of the housing in the axial direction appears. The axial extension of the housing is considerably reduced through the opposition in the supply direction from the axial forces transmitted from the swivel shaft through the axial bearing to the housing. Moreover, the swivel shaft also is provided on the inlet side with the previously described stressing device, so the axial elongation of the housing as a result of the stiffness of the swivel shaft with respect to tensile loading can be almost fully suppressed.

Finally, it is expedient to surround the openings of the swivel body with wear rings that are axially movably journalled on the respective faces of the pressure bodies.

As a result it is achieved through the invention that the swivel body is controlled axially only from the swivel shaft and also is supported on this in the axial direction, so that the swivel shaft experiences no bending loading and the control housing experiences no torsional thrust loading. This has the advantage, inter alia, that the gaskets mounted on the swivel body which optimally lie against the contact surface of the control housing running normal to the pivot shaft under the pressure of the concrete, can adapt to these circumstances. Thus dissimilar wear, equally as construction errors of the housing, can be equalized.

Finally the construction according to the invention provides that the abrasion during the swivel process and therewith also the wear can be held to a minimum because the axial force can be supported outside the concrete in a normal rotary friction bearing. Since the remaining axial elongation of the housing is very small, every tendency to the jamming through the sand particles pressed in the cracks is effectively counteracted.

In the following, the invention is further explained with the aid of an exemplary embodiment.

In the Figures,

FIG. 3 is a section along the line III—III of FIG. 1,

FIG. 4 is a section along the line IV—IV of FIG. 1, and

Figure 2:
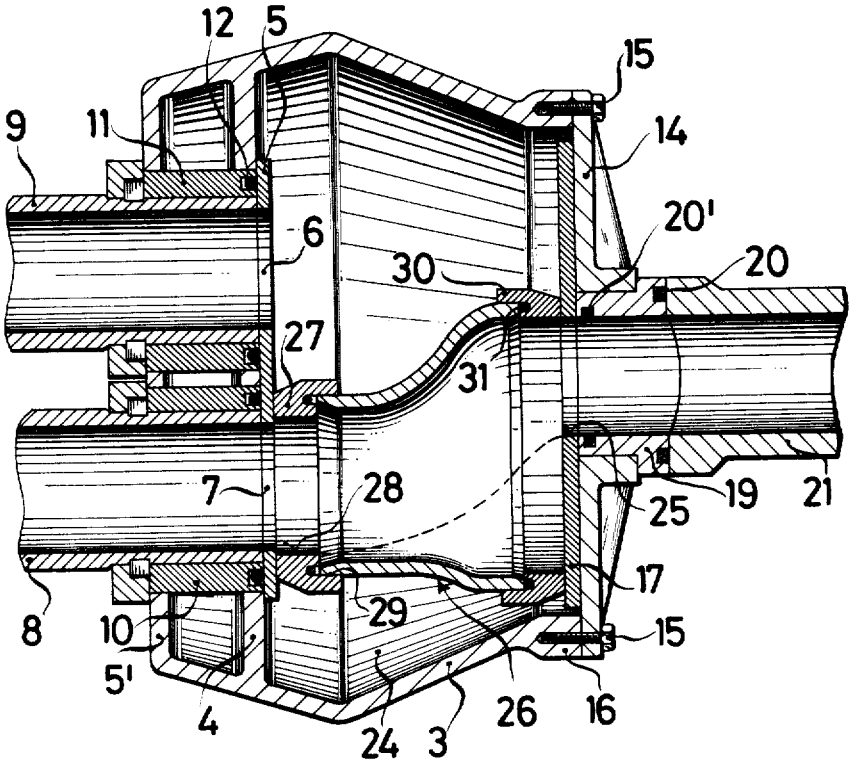
FIG. 2 is a section along the line II—II of FIG. 1.

According to the disclosed exemplary embodiment, a switch tube indicated generally by 2 is under a reservoir 1 shown by dotted lines. The switch tube has, according to the exemplary embodiment, a housing 3 of axially short construction. This housing is in cross-section divided by a rib 4, that forms a transverse wall. On the transverse wall a spectacle shaped plate 5 is fastened, in which inlet openings 6 and 7 are formed for the concrete supplied from two delivery cylinders 8 and 9 (FIG. 2). The ends of the pair of delivery cylinders 8 and 9 are held in sleeves 10 and 11, that carry, on their faces, gaskets 12 and are held in the transverse wall 4 of the rearward housing 5'. The housing, that is formed as a single piece with the referred to walls 4 and 5', is closed through a cap 14. On the bolt circle of the cap 14 are arranged bolts 15 that can be tapped in corresponding holes in the housing flange 16. On the inside of the cap is found a plate 17 with a discharge opening 25. A sleeve 19 with gaskets 20 and 20' serves for the fluid connection of a conveying conductor 21 in which the pump presses the concrete being conveyed.

The pair of delivery cylinders 8 and 9 alternately suck concrete out of the reservoir 1 through the interior 24 of the housing 3. In the following cycle the cylinders alternately press the suctioned concrete through the inlet openings 6 and 7 in the spectacle shaped plate 5. Before this cycle begins the inlet openings 6 and 7 are connected with the discharge opening 25 of the housing provided in the wear plate 17. For this a swivel body indicated generally by 26 (FIGS. 1 and 2) serves, the configuration of which is particularly apparent from FIGS. 3 and 4. The swivel body has, according to FIG. 3, an axially movable ring 27 shown in FIG. 2 surrounding inlet opening 28, which ring is surrounded by the rim shown with 29 in FIG. 2. This edge gives the inlet opening 28, according to the disclosed exemplary embodiment, a circular form of area $A_1$ shown in FIG. 3. The center of gravity therefor rests in the middle of the circular area $A_1$ defined by ring 27 and across which the concrete pressure appears.

Further, the swivel body has, as shown in particular in FIG. 4, on its oppositely lying end a discharge surface surrounded by an axially movable ring 30. This surface is bordered by the front edge 31 of the swivel body 26 and is indicated with 32. Its outline is kidney formed, as particularly shown in FIG. 4. Within the kidney formed outline accordingly the circularly formed discharge openings partially coincide. The center of gravity of the kidney formed area $A_2$ shown in FIG. 4 and across which the concrete pressure appears lies in the middle of the kidney formed discharge opening 32. It possesses a radial displacement $R_2$, from the geometrical axis shown by 35 in FIG. 1, while the previously described inlet opening possesses a radial distance $R_1$ from the geometrical axis 35.

The swivel body 26 is, according to the disclosed exemplary embodiment, formed as a single element with an arm 37, which coacts with a bearing cap 38. The bearing cap 38 is connected by means of two bolt pairs 39 and 40 with the arm 37 so that a middle section of a swivel shaft 44 can extend between both the described parts.

Figure 5:
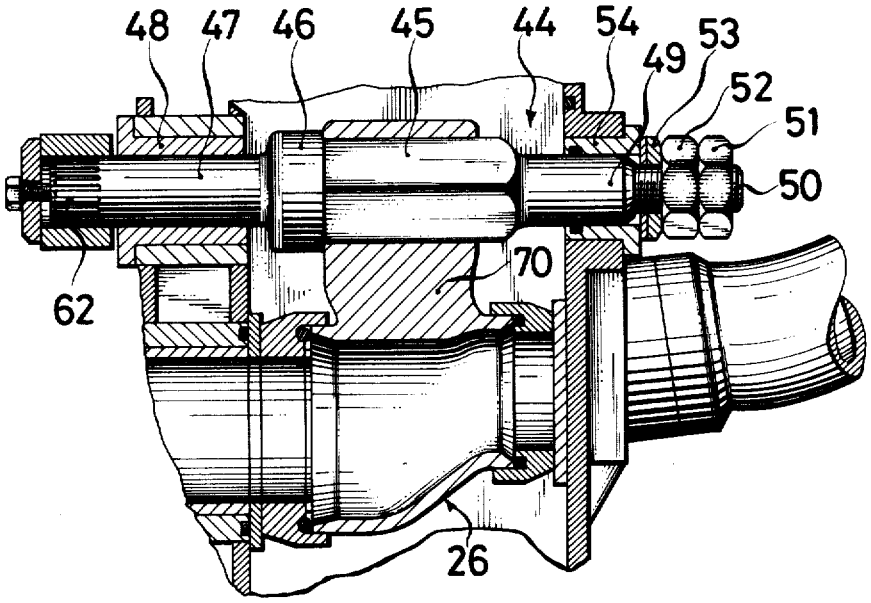
FIG. 5 is a section along the line V—V of FIG. 3.

As shown in FIG. 5 according to the there disclosed exemplary embodiment, the swivel shaft 44 in the region of the swivel body 26 is provided with a plural sided section 45. This ends in a band 46 increased in diameter, so that the swivel body 26 can be axially fastened on the shaft. The band 46 changes to a cylindrical section, reduced in diameter, which is supported in a combination radial and axial bearing 48. On the oppositely lying end the many sided section 45 changes to a cylindrical section 49 of reduced diameter, that continues in a spindle section 50 of further reduced diameter. On the spindle section a nut 52 with a counter nut 51 is threaded. Through the nuts the swivel shaft is supported on a multi-part disc 53, that, in turn, is supported on the face of a bearing sleeve 54. The bearing sleeve 54 comprises an axial thrust bearing that is loaded against the conveying direction of the concrete through the swivel body 26.

As the hydrostatically loaded surface of the swivel body 26 in the inlet opening according to FIG. 3 is $A_1$ and the hydrostatically loaded surface of the kidney formed discharge surface of the swivel body according to FIG. 4 is $A_2$, there results $$A_2 = z \cdot A_1$$

so that the value z expresses the ratio of the inlet opening area to the kidney formed discharge area.

The inlet opening $A_1$ is hydraulically loaded with $K_1$ (i.e. $A_1$ times the concrete pressure) and the discharge opening $A_2$ with $K_2$ (i.e. $A_2$ times the concrete pressure), so there results as a condition for the moment balance $$K_1 \cdot R_1 = K_2 \cdot R_2$$

Figure 1:
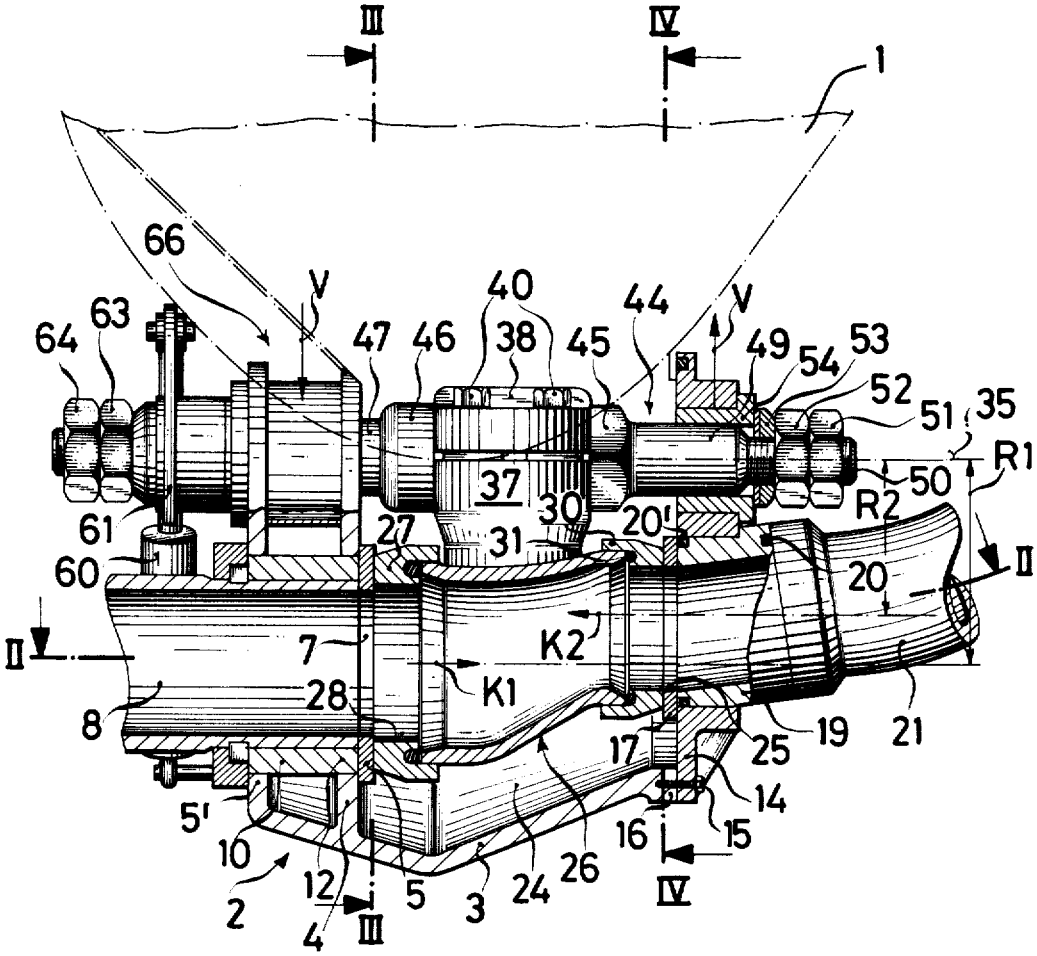
FIG. 1 is a broken away representation of a viscous material pump according to the invention in side view and partially in section.

Since $$K_2 = z \cdot K_1$$

because $$A_2 - z \cdot A_2,$$

if $$R_1 = z \cdot R_2,$$

it means that the forces V in FIG. 1 produced on the two bearings of the swivel shaft do not appear so that $$V = 0.$$

There thus results: the radial distances R from the swivel shaft are so selected that the distance $R_1$ of the inlet opening center of gravity is z times greater than the distance $R_2$ of the center of gravity of the kidney formed discharge opening, so no forces normal to the shaft and thus its bearing results, because the moments are equal to zero. The shaft is thus not loaded in flexion. The housing is also not canted.

According to the disclosed exemplary embodiment the pivot shaft is actuated by means of a thrust piston drive 60 through a crank 61, which, as shown in FIG. 5 operates on the end 47 of the shaft provided with spline 62. While according to the exemplary embodiment shown in FIG. 5 the cylinder side end of the shaft 44 is simply lead in the bearing 48, this pivot shaft end, in the exemplary embodiment of FIG. 1, has a form which corresponds to that in the bearing, which is established in the housing side carrying the housing cap 14. By means of a nut 63 and a nut 64 correspondingly can the pivot shaft on its both ends be stressed, so as to oppose deformation of the parts, that take the axial bearing load. The splines 62 are accordingly arranged beyond the nuts 62 and 63, which render possible the axial tension and pertains to the bearing shown generally with 66.

Accordingly the invention is thus arranged so that the swivel shaft 44, on which the swivel body 26 is suspended, is supported axially on at least one bearing 54 or 66, that can be arranged on the forward or rear housing wall 17 or 4, 5'.

Thus, the inlet openings 6, 7 which from the swivel body 26 and its gaskets 27 are referenced and according to the exemplary embodiment are arranged in a spectacle shaped plate, are so mounted that the displacement of its middle or center of gravity from the axis of the swivel shaft is greater than the corresponding displacement of the discharge opening.

The swivel body is so formed that it covers in both of the end positions of the pivot shaft 44, both the inlet openings 6 and 7 in the housing and, on the oppositely lying housing side, the discharge opening in the housing. The swivel body and the arm 70 in FIG. 5 and 37 in FIG. 3 connecting it with the pivot shaft are so formed, that the initially described coordination of the swivel body to the pivot shaft results.

The arrangement is further so assembled that the faces of the swivel body 26 end in front of the housing walls arranged normal to them and the thus resulting gap is bridged through the wear ring.

Beyond that, axes are present in the swivel body, which connect, respectively, one of the pair of discharge openings with the inlet opening. These axes are inclined to a greater extent than would be necessary if all openings had the same displacement from the pivot shaft axis. Finally, the swivel angle is held proportionately small, so that the exemplary embodiment results in the kidney shaped discharge opening shown in FIG. 4, in which the two discharge openings necessary with larger swivel angles comprise only one opening.

I claim:

1. A viscous material pump comprising:

a housing (3) receiving the viscous material to be pumped, said housing having a wall containing a conduit opening by which the viscous material is passed from the pump and an opposing wall containing a pair of cylinder openings;

a swivel body (26) having a material passage extending between a discharge opening (32) and an inlet opening (28), the area ($A_2$) of said discharge opening (32) being of a different size than the area ($A_1$) of said inlet opening, said swivel body being movably positioned in said housing intermediate said opposing walls for alternately connecting the cylinder openings with the conduit opening; and a swivel shaft (44) from which said swivel body extends, said swivel shaft being mounted on said housing for moving said swivel body about an axis of rotation (35) extending generally in the direction of the swivel body passage, said discharge and inlet openings of said swivel body being radially displaced from the axis of rotation such that the product of the area ($A_2$) of the discharge opening (32) and the displacement ($R_2$) of the center of gravity of that area from the axis of rotation is similar to the product of the area ($A_1$) of the inlet opening (28) and the displacement ($R_1$) of the center of gravity of that area from the axis of rotation.

2. The viscous material pump according to claim 1 wherein said discharge opening (32) of the said swivel body (26) is kidney-shaped in form.

3. The viscous material pump according to claim 1 wherein the pumping of the viscous material generates axial forces in said swivel shaft, and wherein said housing includes a bearing (51-54) for said swivel shaft (44), said bearing being preloaded in opposition to the axial forces appearing in said shaft from the pumping of the material.

4. The viscous material pump according to claim 3 wherein said housing has a spaced pair of bearings for receiving said swivel shaft on opposite sides of the extension of said swivel body, said bearings retaining said shaft such that said shaft resists axial stresses applied to said housing from the pumping of said material.

5. The viscous material pump according to claim 1 wherein the discharge and inlet openings of said swivel body are surrounded by wear rings (27, 30) that are axially movably supported on the swivel body (26).

* * * * *